US009348304B2

(12) United States Patent
Sato et al.

(10) Patent No.: US 9,348,304 B2
(45) Date of Patent: May 24, 2016

(54) PROCESS CARTRIDGE

(75) Inventors: Fumikazu Sato, Konan (JP); Shota Shinoya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/599,572

(22) Filed: Aug. 30, 2012

(65) Prior Publication Data

US 2013/0051850 A1 Feb. 28, 2013

(30) Foreign Application Priority Data

Aug. 30, 2011 (JP) ..... 2011-186890

(51) Int. Cl.
*G03G 21/00* (2006.01)
*G03G 21/18* (2006.01)

(52) U.S. Cl.
CPC ..... *G03G 21/1821* (2013.01); *G03G 21/00* (2013.01); *G03G 21/0058* (2013.01)

(58) Field of Classification Search
CPC .. G03G 21/00; G03G 21/0058; G03G 21/007
USPC ..... 399/111, 113, 117, 123
See application file for complete search history.

(56) References Cited

U.S. PATENT DOCUMENTS 6,928,252 B2 * 8/2005 Takami et al. ..... 399/111
7,454,154 B2 11/2008 Matsumoto et al.
2007/0116490 A1 5/2007 Matsumoto et al.
2010/0278571 A1 11/2010 Abe et al.
2011/0069989 A1 * 3/2011 Kim ..... 399/115

FOREIGN PATENT DOCUMENTS

JP 03059585 A * 3/1991
JP 05289581 A * 11/1993
JP 2004-361632 A 12/2004
JP 2006-184751 A 7/2006
JP 2007-140167 A 6/2007
JP 2010-262097 A 11/2010

OTHER PUBLICATIONS

Aug. 4, 2015—(JP) Notification of Reasons for Refusal—App 2011-186890, Eng Tran.
Feb. 2, 2016—(JP) Notification of Reasons for Refusal—App 2011-186890, Eng Tran.

* cited by examiner

*Primary Examiner* — Erika J Villaluna
(74) *Attorney, Agent, or Firm* — Banner & Witcoff, Ltd.

(57) ABSTRACT

A process cartridge includes: a photoconductor having a peripheral surface; a first roller having a peripheral surface to be pressed against the peripheral surface of the photoconductor and configured to rotate around a first axis of rotation; a second roller having a peripheral surface to be pressed against the peripheral surface of the first roller and configured to rotate around a second axis of rotation which is parallel to the first axis of rotation; a first urging member configured to urge the first roller and the second roller in a first direction toward the photoconductor; and a second urging member configured to urge the second roller in a second direction toward the first roller. The second urging member is arranged such that the second direction is parallel to the first direction.

21 Claims, 7 Drawing Sheets

PROCESS CARTRIDGE

CROSS-REFERENCE TO RELATED APPLICATION(S)

This application claims priority from Japanese Patent Application No. 2011-186890 filed on Aug. 30, 2011, the disclosure of which is incorporated herein by reference in its entirety.

TECHNICAL FIELD

The present invention relates to a process cartridge comprising a first roller configured to rotate in contact with a photoconductor, and a second roller configured to rotate in contact with the first roller.

BACKGROUND ART

There is known an image forming apparatus such as a laser printer which comprises a photoconductor drum (photoconductor), and a cleaning unit for removing foreign objects adhering to a surface of the photoconductor drum. More specifically, the cleaning unit includes a first cleaning roller configured to rotate in contact with the photoconductor drum and to collect foreign objects adhering to the surface of the photoconductor drum, and a second cleaning roller configured to rotate in contact with the first cleaning roller to collect the foreign objects collected by the first cleaning roller. In this cleaning unit, the first cleaning roller is disposed at a rear side of the photoconductor drum, and the second cleaning roller is disposed at an upper side of the first cleaning roller. According to this conventional image forming apparatus, the first cleaning roller is pressed against the photoconductor drum in a first direction, and the second cleaning roller is pressed against the first cleaning roller in a second direction which is different from the first direction.

However, according to an image forming apparatus with the above conventional configuration, because the first cleaning roller and the second cleaning roller rotate concurrently while they are in contact with each other, each of the rollers deforms at its center portion, which leads to unstable contact pressure between the first cleaning roller and the second cleaning roller.

SUMMARY OF THE INVENTION

In view of the above, it would be desirable to provide a process cartridge, which can prevent deformation of a first roller rotating in contact with a photoconductor.

According to an aspect of the present invention, a process cartridge comprises: a photoconductor having a peripheral surface; a first roller having a peripheral surface to be pressed against the peripheral surface of the photoconductor and configured to rotate around a first axis of rotation; a second roller having a peripheral surface to be pressed against the peripheral surface of the first roller and configured to rotate around a second axis of rotation which is parallel to the first axis of rotation; a first urging member configured to urge the first roller and the second roller in a first direction toward the photoconductor; and a second urging member configured to urge the second roller in a second direction toward the first roller. In this process cartridge, the second urging member is arranged such that the second direction is parallel to the first direction.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENT

Figure 1:
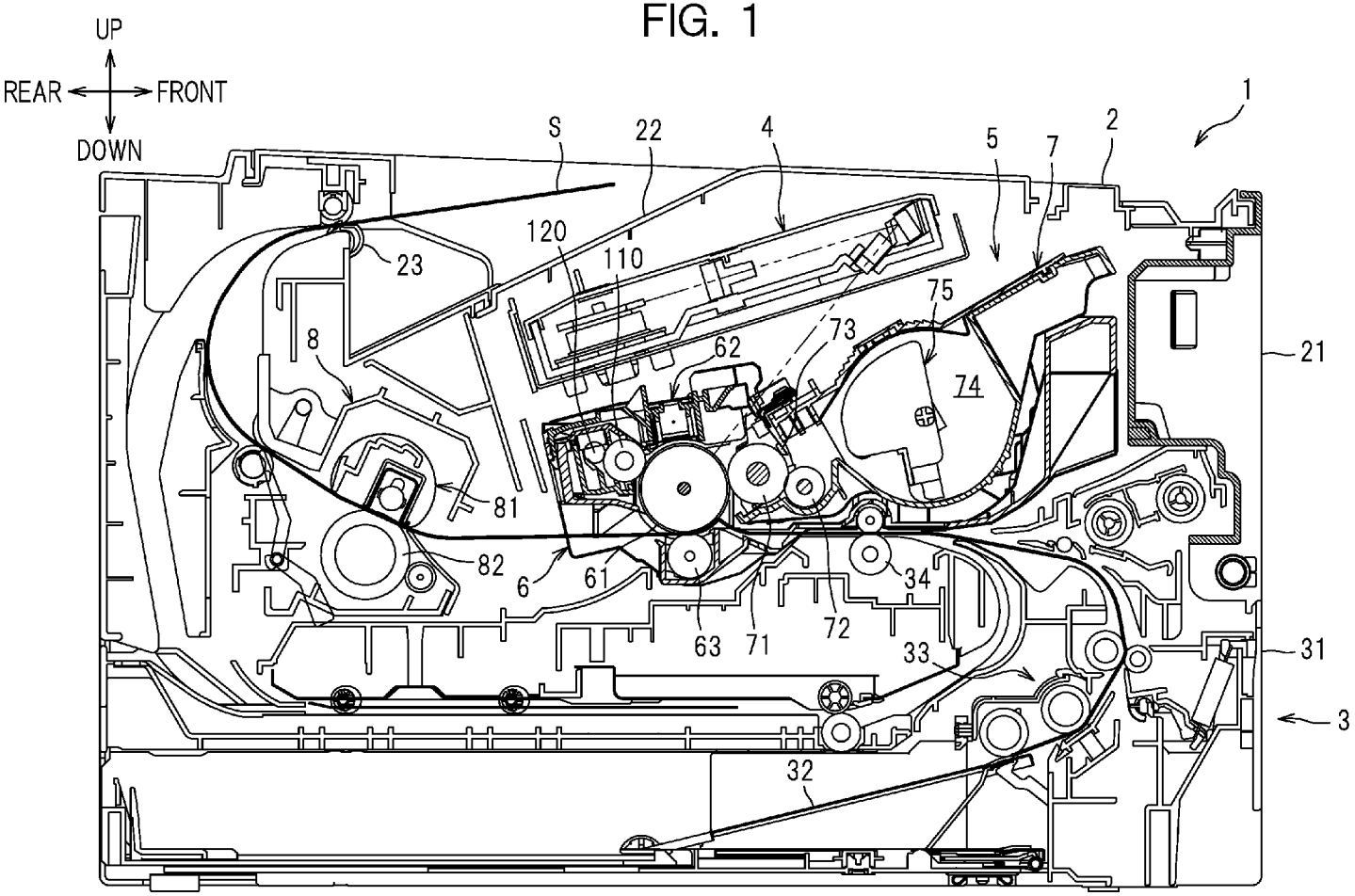
FIG. 1 is a schematic sectional view of a laser printer including a process cartridge according to one exemplary embodiment of the present invention.

A detailed description will be given of an illustrative embodiment of the present invention with reference to the accompanying drawings. In the following description, a general arrangement of a laser printer comprising a process cartridge according to one exemplary embodiment of the present invention will be described, and thereafter characteristic features of the present invention will be described in detail.

In the following description, the direction is designated as from the viewpoint of a user who is using (operating) the laser printer. To be more specific, in FIG. 1, the right-hand side of the drawing sheet corresponds to the "front" side of the laser printer, the left-hand side of the drawing sheet corresponds to the "rear" side of the laser printer, the front side of the drawing sheet corresponds to the "left" side of the laser printer, and the back side of the drawing sheet corresponds to the "right" side of the laser printer. Similarly, the direction extending from top to bottom of the drawing sheet corresponds to the "vertical" or "upward-and-downward (up/down, upper/lower or top/bottom)" direction of the laser printer.

General Arrangement of Laser Printer

As seen in FIG. 1, a laser printer 1 includes a main body casing 2, and several components housed within the main body casing 2 which principally includes a sheet feeder unit 3 for feeding a sheet of paper (hereinafter simply referred to as a "sheet" S) as an example of a recording sheet, an exposure device 4, a process cartridge 5 for transferring a toner image onto a sheet S, and a fixing device 8 for thermally fixing the toner image transferred onto the sheet S.

The sheet feeder unit 3 is provided in a lower space within the main body casing 2, and principally includes a sheet feed tray 31, a sheet pressure plate 32, and a sheet feed mechanism 33. Sheets S stored in the sheet feed tray 31 are urged upward by the sheet pressure plate 32, and then supplied to the process cartridge 5 (between a photoconductor drum 61 and a transfer roller 63) by the sheet feed mechanism 33.

The exposure device 4 is provided in an upper space within the main body casing 2, and principally includes a laser beam emitter (not shown), a polygon mirror, lenses, and reflecting mirrors, which are shown in the figure without reference numerals. The exposure device 4 is configured to cause a laser beam produced based upon image data and emitted from the laser beam emitter to travel along a path indicated by chain double-dashed line, so that a peripheral surface of the photoconductor drum 61 is rapidly scanned and illuminated consecutively with the laser beam.

The process cartridge 5 is disposed below the exposure device 4 within the main body casing 2, and configured to be installable in and removable from the main body casing 2 through an opening formed when a front cover 21 provided at the main body casing 2 is swung open. The process cartridge 5 includes a drum cartridge 6 and a development cartridge 7.

The drum cartridge 6 principally includes a photoconductor drum 61, a charger 62, and a transfer roller 63. The development cartridge 7 is configured to be detachably attached to the drum cartridge 6. The development cartridge 7 principally includes a development roller 71, a supply roller 72, a doctor blade 73, and a toner reservoir 74 for storing toner.

In this process cartridge 5, the peripheral surface of the photoconductor drum 61 is uniformly and positively charged by the charger 62, and then exposed to a rapidly sweeping laser beam from the exposure device 4. Therefore, the electric potential of the exposed area lowers so that an electrostatic latent image associated with image data is formed on the surface of the photoconductor drum 61. Meanwhile, toner in the toner reservoir 74 is supplied via the supply roller 72 to the development roller 71, during which the toner is triboelectrically and positively charged between the supply roller 72 and the development roller 71. When the development roller 71 rotates, the toner on the development roller 71 goes through between the development roller 71 and the doctor blade 73, so that, while being further triboelectrically charged, a thin layer of toner having a predetermined thickness is carried on the development roller 71.

The toner carried on the development roller 71 is supplied from the development roller 71 to the electrostatic latent image formed on the photoconductor drum 61. Accordingly, the electrostatic latent image is visualized and a toner image is formed on the photoconductor drum 61. Thereafter, while a sheet S is conveyed through between the photoconductor drum 61 and the transfer roller 63, the toner image on the photoconductor drum 61 is transferred onto the sheet S.

The fixing device 8 is provided at the rear side of the process cartridge 5. The fixing device 8 principally includes a heating unit 81 and a pressure roller 82. The heating unit 81 includes a halogen heater, a fixing belt, and a nip plate, which are shown in the figure without reference numerals. The pressure roller 82 is configured to nip the fixing belt against the nip plate of the heating unit 81. In the fixing device 8, the toner image transferred onto the sheet S is thermally fixed on the sheet S while passing through between the heating unit 81 and the pressure roller 82. The sheet S with the toner image thermally fixed thereon is ejected by a sheet delivery roller 23 onto a sheet output tray 22.

Detailed Structure of Process Cartridge

A structure of the process cartridge 5 will be described in detail.

As described above, the process cartridge 5 includes the drum cartridge 6, and the development cartridge 7 configured to be detachably attached to the drum cartridge 6.

Figure 2:
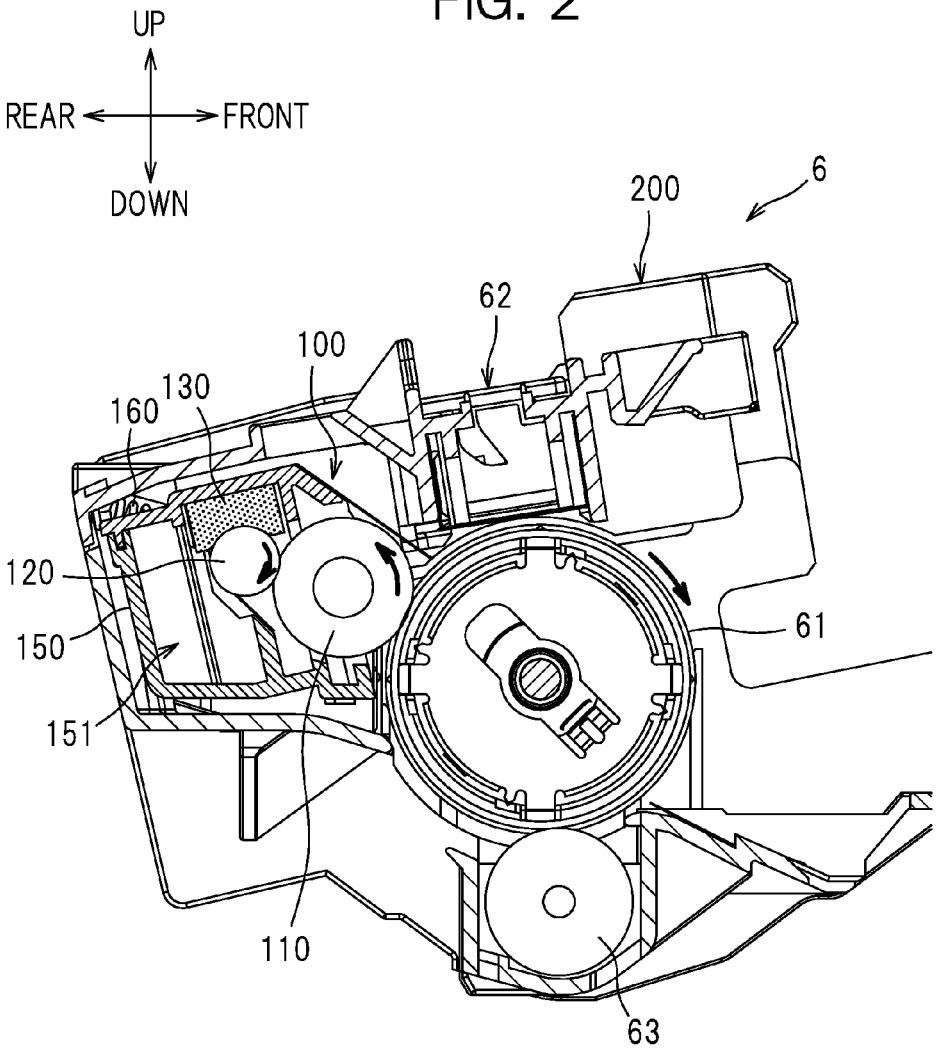
FIG. 2 is a sectional view taken along the line II-II of FIG. 6A, showing detailed structure around a cleaning unit.

As seen in FIG. 2, the drum cartridge 6 includes the photoconductor drum 61, a cleaning unit 100, and a pair of coil springs 160 (see FIG. 4) as an example of a first urging member, at a rear side of a casing 200 of the drum cartridge 6.

The cleaning unit 100 principally includes a cleaning roller 110 and a backup roller 120, which are examples of a first roller and a second roller arranged substantially in a horizontal plane, a scraper member 130, a pair of bearings 140 (see FIG. 3) as an example of a second urging member, and a casing 150.

The cleaning roller 110 is an elongated roller extending in the right-and-left direction, and is configured to rotate in contact with a peripheral surface of the photoconductor drum 61 and collect and temporarily retain for disposal foreign objects such as paper dusts adhering to the peripheral surface of the photoconductor drum 61. The cleaning roller 110 is pressed against the peripheral surface of the photoconductor drum 61 by coil springs 160 to be described later in detail.

To be more specific, as best seen in FIG. 1, the cleaning roller 110 is disposed opposite to the photoconductor drum 61 in a position within a region, along which the peripheral surface of the photoconductor drum 61 moves after passing by the transfer roller 63 before reaching the charger 62.

The cleaning roller 110 is configured to attract and retain negatively charged paper dusts adhering to the peripheral surface of the photoconductor drum 61 during the printing operation of the laser printer 1.

The backup roller 120 is an elongated roller extending in the right-and-left direction, and is configured to rotate in contact with a peripheral surface of the cleaning roller 110 to attract and collect paper dusts retained by the cleaning roller 110.

To be more specific, the backup roller 120 is disposed opposite to the cleaning roller 110 at a position diagonally rearward and upward of the cleaning roller 110 such that the shaft (second axis of rotation) 121 of the backup roller 120 is parallel to the shaft (first axis of rotation) 111 of the cleaning roller 110. More specifically, the backup roller 120 is arranged such that a direction in which the cleaning roller 110 and the backup roller 120 are facing to each other (i.e., direction extending in a plane connecting the shaft 111 of the cleaning roller 110 and the shaft 121 of the backup roller 120 are connected) coincides with (i.e., parallel to) the urging direction of the coil springs 160 to be described later (see outline arrow in FIG. 5). The backup roller 120 is pressed against the peripheral surface of the cleaning roller 110 by a pair of bearings 140 to be described later in detail.

A positive electric voltage having an absolute value greater than that of a positive electric voltage to be applied to the cleaning roller 110 is applied to the backup roller 120, so that the backup roller 120 attracts and retains the paper dusts which have been retained by the cleaning roller 110.

The scraper member 130 is configured to scrape off the paper dusts adhering to the surface of the backup roller 120. The scraper member 130 is disposed at an upper side of the backup roller 120 and slidably contacts the surface of the backup roller 120. The scraper member 130 is made of sponge and pressed against the backup roller 120.

Figure 3:
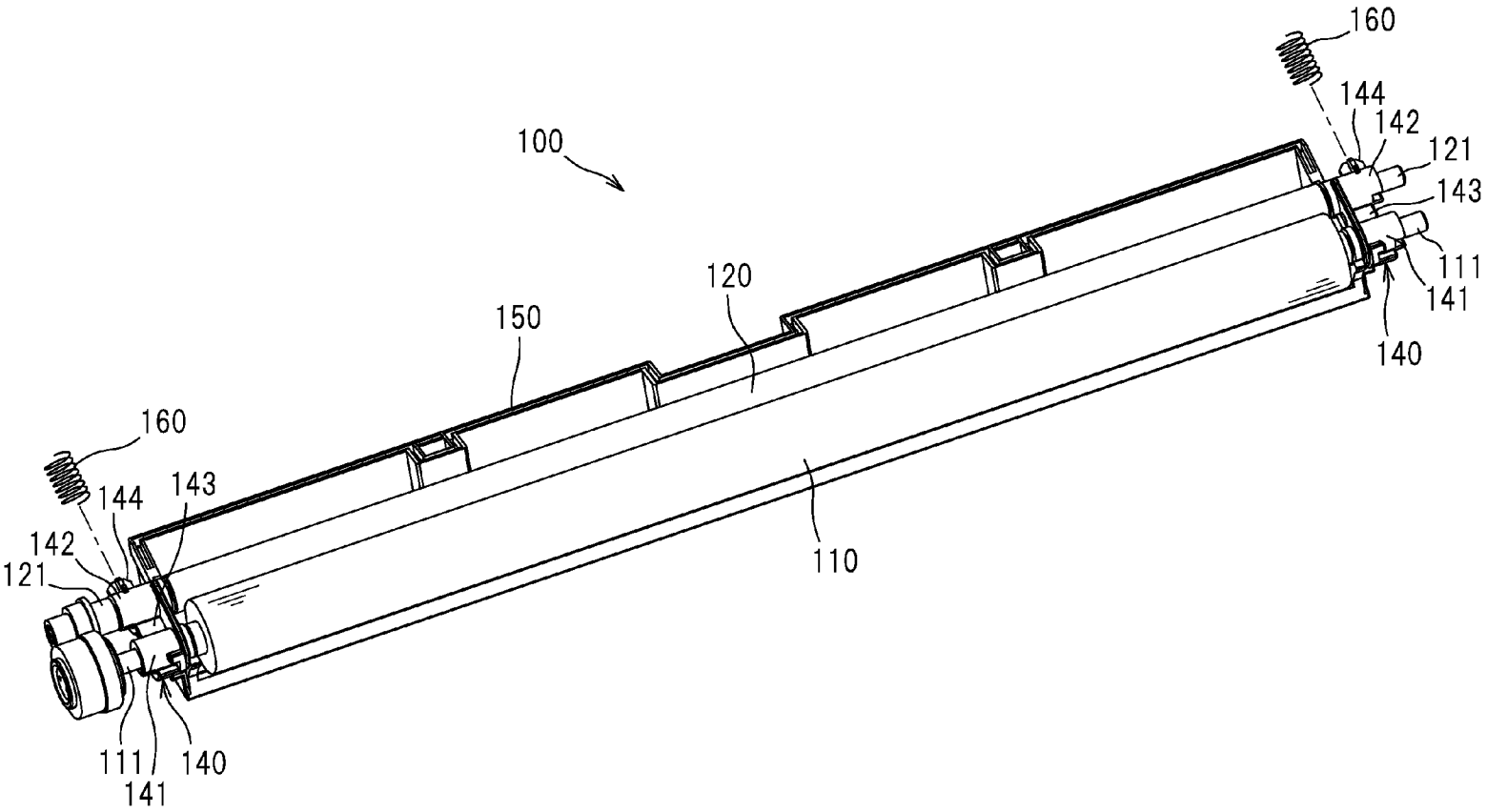
FIG. 3 is a perspective view of the cleaning unit.

As seen in FIG. 3, a pair of bearings 140 is provided at both end portions of the cleaning roller 110 and the backup roller 120. Each of the bearings 140 includes a first bearing portion 141, a second bearing portion 142, a connecting portion 143, and a coil spring support portion 144, which are formed together.

The first bearing portion 141 is shaped as a circular cylinder and configured to support the shaft 111 of the cleaning roller 110 while allowing rotation thereof. The second bearing portion 142 is shaped as a circular cylinder and configured to support the shaft 121 of the backup roller 120 while allowing rotation thereof.

The connecting portion 143 is disposed between the first bearing portion 141 and the second bearing portion 142 and configured to connect the first bearing portion 141 and the second bearing portion 142. Providing the connecting portion 143 makes it possible to maintain a constant spacing between the shaft 111 of the cleaning roller 110 and the shaft 121 of the backup roller 120. Accordingly, the cleaning roller 110 and the backup roller 120 are urged by a predetermined pressure while the shaft 111 of the cleaning roller 100 and the shaft 121 of the backup roller 120 are positioned by the connecting portion 143.

The coil spring support portion 144 extends outward from the rear end of the second bearing portion 142 in a direction in which the cleaning roller 110 and the backup roller 120 face each other.

The casing 150 is configured to accommodate the cleaning roller 110 and the backup roller 120. As seen in FIG. 2, a foreign object storage container 151 is provided within the casing 150 in a space below the backup roller 120; the foreign object storage container 151 is configured to receive paper dusts scraped off by the scraper member 130.

Figure 5:
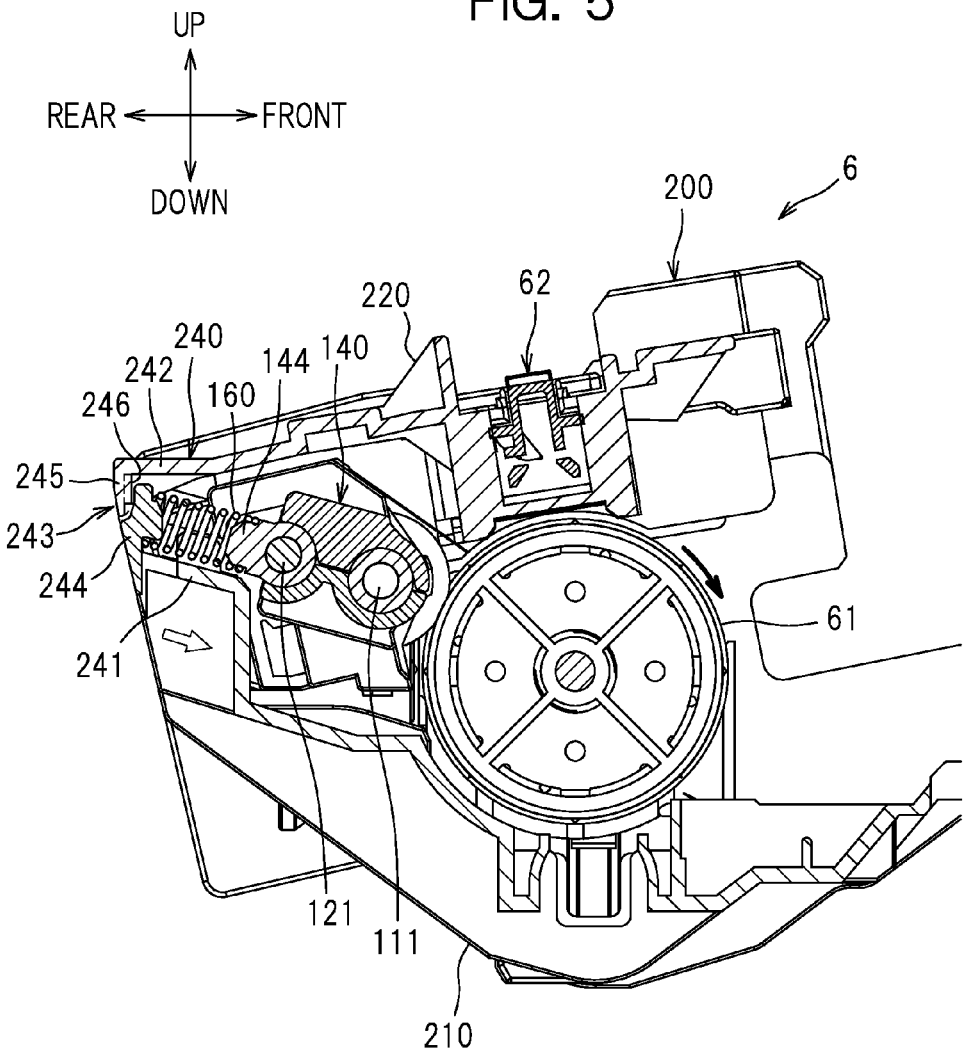
FIG. 5 is a sectional view taken along the line V-V of FIG. 6A, showing detailed structure around a receiving portion.

As best seen in FIG. 5, the coil spring 160 urges the cleaning roller 110 toward the photoconductor drum 61. The coil spring 160 has a first end portion which faces the photoconductor drum 61 in the urging direction of the coil spring 160 and a second end portion opposite the first end portion. To be more specific, the coil spring 160 is arranged at the rear side of the bearing 140 between the bearing 140 and the casing 200, and positioned with the front end (first end portion) thereof supported by the coil spring support portion 144 of the bearing 140 and with the rear end (second end portion) thereof supported by a support portion 244 of the casing 200 to be described later. Accordingly, the urging direction of the coil spring 160 coincides with (i.e., parallel to) the direction in which the cleaning roller 110 and the backup roller 120 are facing to each other (i.e., direction in which the backup roller 120 is urged by the pair of bearings 140 toward the cleaning roller 110). The coil spring 160 directly presses each of the bearings 140 toward the photoconductor drum 61, so that the cleaning roller 110 and the backup roller 120 are urged toward the photoconductor drum 61.

The casing 200 of the drum cartridge 6 accommodates the photoconductor drum 61 and the cleaning unit 100. The casing 200 of the drum cartridge 6 is formed by assembling two frames including a lower frame 210 as an example of a first frame and an upper frame 220 as an example of a second frame. The casing 200 is divided into the lower frame 210 and the upper frame 220 (i.e., pair of frames) along guides 230 to be described later.

Figure 4:
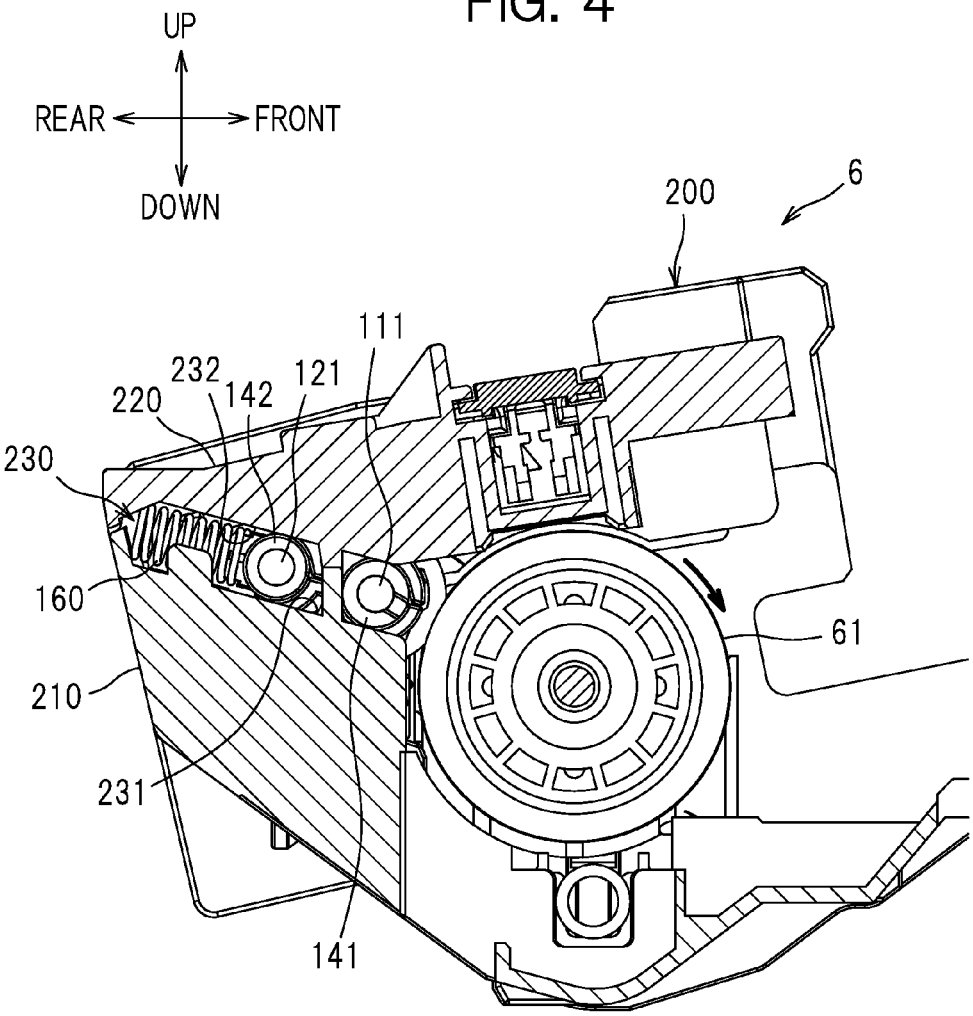
FIG. 4 is a sectional view taken along the line IV-IV of FIG. 6A, showing detailed structure around a guide portion of a casing.

As best seen in FIG. 4, the casing 200 has a pair of guides 230 (only one of them is shown in the figure).

The guides 230 are grooves formed inside and adjacent to right and left side walls of the casing 200 and extending in the urging direction of the coil springs 160. Each guide 230 includes a lower guide 231 disposed below the first bearing portion 141 and the second bearing portion 142 of the bearing 140, and an upper guide 232 disposed above the first bearing portion 141 and the second bearing portion 142 of the bearing 140, at a position outside a receiving portion 240 to be described later in an axial direction of the cleaning roller 110 (see the cutting plane line IV-IV of FIG. 6A). The lower guide 231 and the upper guide 232 extend in the front-and-rear direction along the urging direction of the coil spring 160.

The guides 230 are grooves extending in the urging direction of the coil springs 160 and allow the cleaning roller 110 and the backup roller 120 to move in a direction toward the photoconductor drum 61. Further, since the first bearing portion 141 and the second bearing portion 142 of each bearing 140 are located between the lower guide 231 and the upper guide 232 of each guide 230, the guides 230 restrict movement of the cleaning roller 110 along a direction in which the photoconductor drum 61 rotates (i.e., rotating direction of the photoconductor drum 61). Therefore, even if the cleaning roller 110 in contact with the photoconductor drum 61 is drawn by the rotating photoconductor drum 61, it is possible to restrict the movement of the cleaning roller in the rotating direction of the photoconductor drum 61.

Figure 6A:
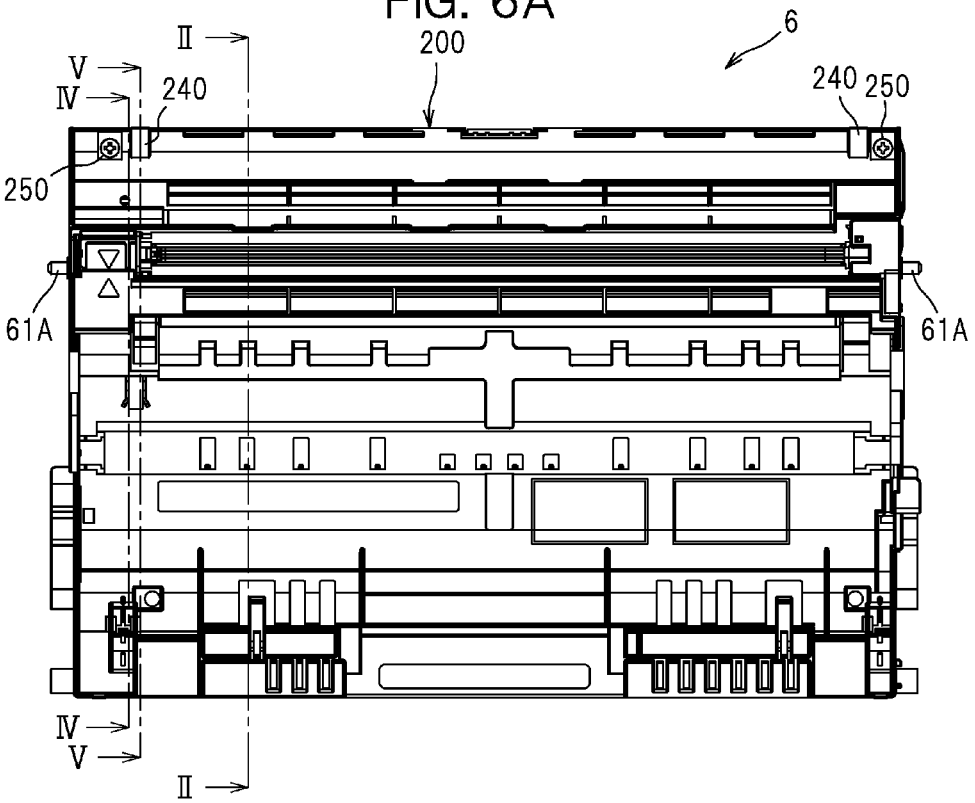
FIG. 6A is a top view of a drum cartridge.
Figure 6B:
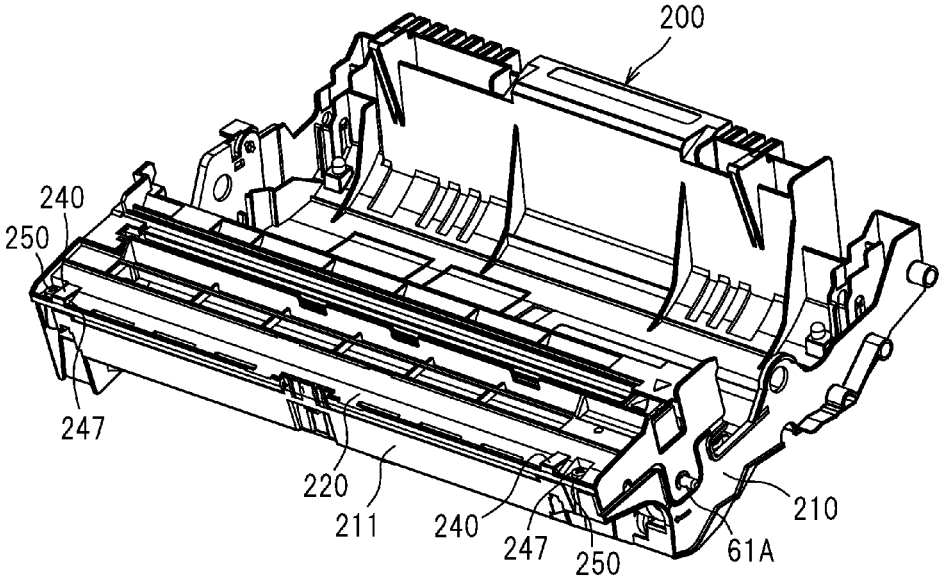
FIG. 6B is a perspective view of the drum cartridge.

Further, as seen in FIGS. 6A and 6B, the casing 200 has receiving portions 240 for receiving the coil springs 160.

Two receiving portions 240 are formed at right and left sides of the casing 200. To be more specific, as seen in FIG. 5, the receiving portions 240 are formed in positions aligned with the pair of bearings 140 in the front-and-rear direction. Each receiving portion 240 has a box-shaped configuration extending outward beyond a rear wall 211 (outer wall) of the casing 200 (see also FIG. 6B). The receiving portion 240 includes a pair of first walls 241, 242 for sandwiching the coil spring 160 from above and below, a second wall 243 for connecting the pair of first walls 241, 242 at a rear side of the coil spring 160 (at the second end portion of the coil spring 160), and a pair of right and left side walls 247 for connecting the pair of first walls 241, 242 and the second wall 243 (only left side walls 247 are shown in FIG. 6B).

The second wall 243 is formed from an edge of the lower frame 210 and an edge of the upper frame 220, which are laid one on another in the front-and-rear direction. To be more specific, the edge of the lower frame 210 has a support portion 244 for supporting the second end portion (rear end) of the coil spring 160. The edge 245 of the upper frame 220 extends behind the support portion 244 and is laid on a back side (outer side) of the support portion 244. The edge 245 of the upper frame 220 has a rib 246 as an example of a protrusion protruding toward and engageable with the back side of the support portion 244, at a position aligned with the support portion 244.

In the casing 200 as described above, components such as the photoconductor drum 61 and the cleaning unit 100 are installed within the lower frame 210. Thereafter, the upper frame 220 is assembled with the lower frame 210, and as seen in FIGS. 6A and 6B, the lower frame 220 and the upper frame 220 are fixed together, at both ends of each guide 230 by a screw 250 and the shaft 61A of the photoconductor drum 61.

Operation and advantageous effects of the process cartridge 5 configured as described above will be described below.

Figure 7A:
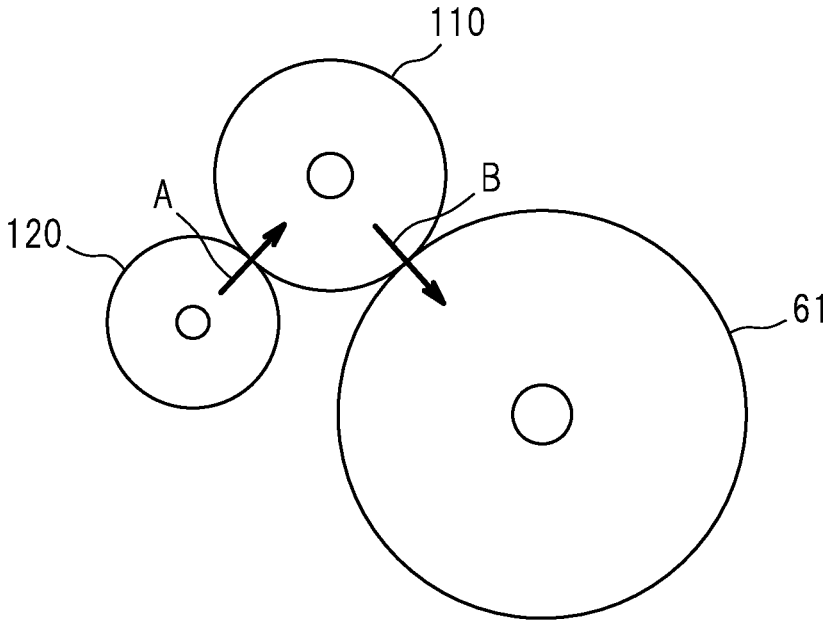
FIG. 7A schematically shows a conventional arrangement of a photoconductor drum, a cleaning roller, and a backup roller.
Figure 7B:
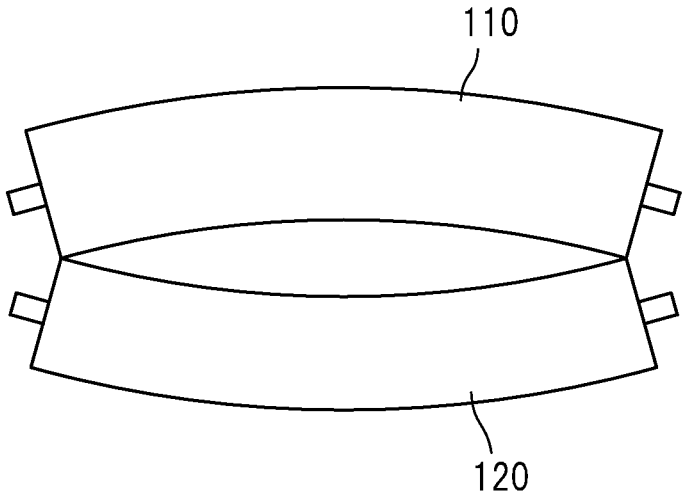
FIG. 7B schematically explains deformation of the cleaning roller and the backup roller.

The cleaning roller 110 and the backup roller 120 rotate in contact with each other with the backup roller 120 urged by the bearings 140 toward the cleaning roller 110, with the result that a pressing force is exerted between the cleaning roller 110 and the backup roller 120. This pressing force causes the cleaning roller 110 and the backup roller 120 to deform in the opposite directions such that the cleaning roller 110 and the backup roller 120 warp in directions away from each other. As best seen in FIG. 7A, according to the conventional image forming apparatus, a direction A in which the backup roller 120 is urged toward the cleaning roller 110 is different from a direction B in which the cleaning roller 110 is urged toward the photoconductor drum 61. Therefore, the pressing force acting between the cleaning roller 110 and the backup roller 120 causes the cleaning roller 110 and the backup roller 120 to deform as shown in FIG. 7B, which leads to unstable contact pressure between them.

In contrast, according to the process cartridge 5 in the above exemplary embodiment, the direction (second direction) in which the backup roller 120 is urged by the bearings 140 toward the cleaning roller 110 coincides with (i.e., parallel to) the direction (first direction) in which the cleaning roller 110 is urged toward the photoconductor drum 61.

Accordingly, even if the cleaning roller 110 tends to deform in the direction away from the backup roller 120 by the pressing force exerted from the backup roller 120, the cleaning roller 110 is pressed against the photoconductor drum 61 at the opposite side away from the backup roller 120. This can prevent deformation of the cleaning roller 110.

Further, since the direction (second direction) in which the bearings 140 urge the backup roller 120 toward the cleaning roller 110 extends in a plane connecting the shaft 111 of the cleaning roller 110 and the shaft 121 of the backup roller 120, the urging force from the backup roller 120 can be transmitted efficiently to the cleaning roller 110. Since the cleaning roller 110 is sandwiched between the backup roller 120 and the photoconductor drum 61, deformation of the cleaning roller 110 can be prevented in a more effective and corrective manner.

Since the pair of integrally-formed bearings 140 are provided by which the shaft 111 of the cleaning roller 110 and the shaft 121 of the backup roller 120 are supported, the axial alignment between the cleaning roller 110 and the backup roller 120 can be improved as compared with a configuration in which a pair of bearings for the cleaning roller 110 and a pair of bearing for the backup roller 120 are separately provided.

Further, the inter-axial distance between the cleaning roller 110 and the backup roller 120 which are supported by the pair of integrally-formed bearings 140 is fixed by the pair of bearings 140. Therefore, according to the configuration in which the pair of coil springs 160 directly push the pair of bearings 140 to urge the cleaning roller 110 and the backup roller 120 toward the photoconductor drum 61, the cleaning roller 110 and the backup roller 120 can be positioned accurately with respect to the photoconductor drum 61 as compared with a configuration in which the coil springs 160 directly press one of the cleaning roller 110 and the backup roller 120.

The casing 200 has the pair of guides 230 at right and left side walls thereof; the guides 230 allow the cleaning roller 110 and the backup roller 120 to move in a direction toward the photoconductor drum 61 while restricting movement of the cleaning roller 110 in a direction in which the photoconductor drum 61 rotates. This can reduce the number of constituent parts as compared with a configuration in which guides are provided separately on the casing 200.

Further, since the casing 200 is divided into the lower frame 210 and the upper frame 220 along the guides 230, the guides 230 can be formed at the same time when the lower frame 210 and the upper frame 220 are assembled with the photoconductor drum 61 disposed therein. This can save time and effort in manufacturing the process cartridge 5.

Since the lower frame 210 and the upper frame 220 for constituting the casing 200 are fixed together at both ends of each guide 230, the guides 230 are fixed at both ends in the guiding direction. Therefore, positions of the guides 230 can be readily determined and deformation of the guides 230 is less likely to occur.

Further, the edge of the lower frame 210 has the support portion 244 for supporting the second end portion of the coil spring 160, and the edge 245 of the upper frame 220 has the rib 246 engageable with the back side of the support portion 244, so that the support portion 244 is reinforced by the rib 246. Therefore, it is possible to prevent deformation of the casing 200 due to the force exerted from the coil springs 160.

Further, the casing 200 has the pair of receiving portions 240 for receiving the pair of coil springs 160, and each receiving portion 240 extends outward beyond the rear wall 211 of the casing 200. This can reduce the thickness of the process cartridge 5 as compared with a configuration in which the whole rear wall 211 has a thickness corresponding to the size of the coil springs 160.

Further, each receiving portion 240 has a box-shaped configuration which includes the pair of first walls 241, 242 extending in the urging direction of the coil spring 160 to receive the coil spring 160 between them, the second wall 243 connecting the pair of first walls 241, 242 at the rear side of the coil spring 160, and the pair of right and left side walls 247 connecting the pair of first walls 241, 242 and the second wall 243. Accordingly, the casing 200 has high rigidity so that the coil springs 160 can be reliably supported by the casing 200.

The cleaning roller 110 and the backup roller 120 are arranged substantially in the horizontal plane. This can reduce the size of the process cartridge 5 in the vertical direction (upward-and-downward direction) as compared with a configuration in which the cleaning roller 110 and the backup roller 120 are arranged in the vertical direction.

Although an illustrative embodiment of the present invention has been described in detail, the present invention is not limited to this specific embodiment. It is to be understood that various changes and modifications may be made without departing from the scope of the appended claims.

In the above exemplary embodiment, the coil springs 160 press the pair of bearings 140 to urge the cleaning roller 110 and the backup roller 120 toward the photoconductor drum 61. However, the present invention is not limited to this specific configuration. For example, the coil springs 160 may press the casing 150 to urge the cleaning roller 110 and the backup roller 120 toward the photoconductor drum 61.

Further, in the above exemplary embodiment, the cleaning roller 110 and the backup roller 120 are exemplified as examples of the first roller and the second roller. However, the present invention is not limited to this specific configuration. For example, the first roller may be a charging roller configured to rotate in contact with the peripheral surface of the photoconductor drum 61 and to positively charge the photoconductor drum 61, and the second roller may be a cleaning roller configured to rotate in contact with the peripheral surface of the charging roller and to clean the charging roller.

In the above exemplary embodiment, the pair of coil springs 160 is exemplified as an example of the urging member. However, the present invention is not limited to this specific configuration. For example, one or more of leaf springs, torsion springs, or wire springs may be employed as the urging member.

In the above exemplary embodiment, the photoconductor drum 61 is employed as an example of the photoconductor. However, the present invention is not limited to this specific configuration. For example, a belt-type photoconductor may be employed.

Further, in the above exemplary embodiment, the process cartridge 5 according to the present invention is adapted to the laser printer 1. However, the present invention is applicable to other image forming apparatuses such as a copying machine and a multifunction peripheral.

What is claimed is:

1. A drum cartridge comprising:

a photoconductor having a peripheral surface;

a charger configured to charge the peripheral surface of the photoconductor;

a cleaning roller having a peripheral surface contacting the peripheral surface of the photoconductor, the cleaning roller including a first shaft and configured to rotate about the first shaft;

a backup roller having a peripheral surface contacting the peripheral surface of the cleaning roller, the backup roller including a second shaft and configured to rotate about the second shaft, the backup roller being disposed on an opposite side of the cleaning roller with respect to the photoconductor;

a bearing configured to support the first shaft and the second shaft in a state where the peripheral surface of the backup roller contacts the peripheral surface of the cleaning roller;

an urging member configured to urge the bearing toward the photoconductor, wherein the entire urging member is disposed on an opposite side of the second shaft with respect to the cleaning roller; and a casing configured to receive the photoconductor, wherein the casing comprises a guide configured to allow the cleaning roller and the backup roller to move in a direction toward the photoconductor while restricting movement of the cleaning roller along a direction in which the peripheral surface of the photoconductor moves, wherein the guide is configured as a groove formed in the casing, and the casing is formed by assembling a first frame and a second frame divided along the groove.

2. The drum cartridge according to claim 1, wherein the first frame and the second frame is fixed together at both ends of the guide.

3. The drum cartridge according to claim 1, wherein the casing is formed by assembling at least two frames including the first frame and the second frame, wherein the urging member comprises a first end portion which faces the photoconductor and a second end portion opposite the first end portion, and wherein an edge of the first frame comprises a support portion configured to support the second end portion of the urging member, and an edge of the second frame comprises a protrusion engageable with a back side of the support portion.

4. The drum cartridge according to claim 1, further comprising:

a casing configured to receive the photoconductor, wherein the casing comprises a guide configured to guide the bearing toward the photoconductor, and wherein the urging member is a compression coil spring disposed in the guide, the compression coil spring being configured to urge the bearing toward the photoconductor.

5. The drum cartridge according to claim 1, wherein the urging member is a spring.

6. A drum cartridge comprising:

a photoconductor having a peripheral surface;

a charger configured to charge the peripheral surface of the photoconductor;

a cleaning roller having a peripheral surface contacting the peripheral surface of the photoconductor, the cleaning roller including a first shaft and configured to rotate about the first shaft;

a backup roller having a peripheral surface contacting the peripheral surface of the cleaning roller, the backup roller including a second shaft and configured to rotate about the second shaft, the backup roller being disposed on an opposite side of the cleaning roller with respect to the photoconductor;

a bearing configured to support the first shaft and the second shaft in a state where the peripheral surface of the backup roller contacts the peripheral surface of the cleaning roller;

an urging member configured to urge the bearing toward the photoconductor, wherein the entire urging member is disposed on an opposite side of the second shaft with respect to the cleaning roller; and a casing configured to receive the photoconductor, wherein the casing comprises a guide configured to allow the cleaning roller and the backup roller to move in a direction toward the photoconductor while restricting movement of the cleaning roller along a direction in which the peripheral surface of the photoconductor moves, wherein the casing comprises a receiving portion configured to receive the urging member, and the receiving portion extends outward beyond an outer wall of the casing.

7. The drum cartridge according to claim 6, wherein the urging member comprises a first end portion which faces the photoconductor and a second end portion opposite the first end portion, and wherein the receiving portion comprises a pair of first walls extending toward the photoconductor to receive the urging member between the first walls, and a second wall connecting the pair of first walls at the second end portion of the urging member.

8. The drum cartridge according to claim 6, further comprising:

a casing configured to receive the photoconductor, wherein the casing comprises a guide configured to guide the bearing toward the photoconductor, and wherein the urging member is a compression coil spring disposed in the guide, the compression coil spring being configured to urge the bearing toward the photoconductor.

9. The drum cartridge according to claim 6, wherein the urging member is a spring.

10. A drum cartridge comprising:

a photoconductor having a peripheral surface;

a charger configured to charge the peripheral surface of the photoconductor;

a cleaning roller having a peripheral surface contacting the peripheral surface of the photoconductor, the cleaning roller including a first shaft and configured to rotate about the first shaft;

a backup roller having a peripheral surface contacting the peripheral surface of the cleaning roller, the backup roller including a second shaft and configured to rotate about the second shaft, the backup roller being disposed on an opposite side of the cleaning roller with respect to the photoconductor;

a bearing configured to support the first shaft and the second shaft in a state where the peripheral surface of the backup roller contacts the peripheral surface of the cleaning roller;

an urging member configured to urge the bearing toward the photoconductor, wherein the entire urging member is disposed on an opposite side of the second shaft with respect to the cleaning roller; and a guide extending in a first direction from the urging member to the photoconductor and configured to guide the cleaning roller and the backup roller in the first direction, wherein the urging member is configured to expand in the first direction along the guide to urge the bearing toward the photoconductor.

11. The drum cartridge according to claim 10, further comprising:

a casing configured to receive the photoconductor, wherein the casing comprises a guide configured to guide the bearing toward the photoconductor, and wherein the urging member is a compression coil spring disposed in the guide, the compression coil spring being configured to urge the bearing toward the photoconductor.

12. The drum cartridge according to claim 10, wherein the urging member is a spring.

13. A drum cartridge comprising:

a photoconductor having a peripheral surface;

a charger configured to charge the peripheral surface of the photoconductor;

a cleaning roller having a peripheral surface contacting the peripheral surface of the photoconductor, the cleaning roller including a first shaft and configured to rotate about the first shaft;

a backup roller having a peripheral surface contacting the peripheral surface of the cleaning roller, the backup roller including a second shaft and configured to rotate about the second shaft, the backup roller being disposed on an opposite side of the cleaning roller with respect to the photoconductor;

a bearing configured to support the first shaft and the second shaft in a state where the peripheral surface of the backup roller contacts the peripheral surface of the cleaning roller; and an urging member configured to urge the bearing toward the photoconductor, wherein the entire urging member is disposed on an opposite side of the second shaft with respect to the cleaning roller, and wherein the urging member is configured to expand in a first direction from the urging member to the photoconductor to urge the bearing toward the photoconductor.

14. The drum cartridge according to claim 13, further comprising a guide extending in the first direction and configured to guide the bearing toward the photoconductor.

15. The drum cartridge according to claim 14, wherein the guide is configured to guide the bearing between the urging member and the photoconductor.

16. The drum cartridge according to claim 13, further comprising a guide configured to guide the bearing between the urging member and the photoconductor in a direction toward the photoconductor.

17. The drum cartridge according to claim 13, further comprising:

a casing configured to receive the photoconductor, wherein the casing comprises a guide configured to guide the bearing toward the photoconductor, and wherein the urging member is a compression coil spring disposed in the guide, the compression coil spring being configured to urge the bearing toward the photoconductor.

18. The drum cartridge according to claim 13, wherein the urging member is a spring.

19. A process cartridge comprising:

a photoconductor having a peripheral surface;

a charger configured to charge the peripheral surface of the photoconductor;

a cleaning roller having a peripheral surface contacting the peripheral surface of the photoconductor, the cleaning roller including a first shaft and configured to rotate about the first shaft;

a backup roller having a peripheral surface contacting the peripheral surface of the cleaning roller, the backup roller including a second shaft and configured to rotate about the second shaft, the backup roller being disposed on an opposite side of the cleaning roller with respect to the photoconductor;

a bearing configured to support the first shaft and the second shaft in a state where the peripheral surface of the backup roller contacts the peripheral surface of the cleaning roller;

an urging member configured to urge the bearing toward the photoconductor; and a guide extending in a first direction from the urging member to the photoconductor and configured to guide the cleaning roller and the backup roller in the first direction, wherein the entire urging member is disposed on an opposite side of the second shaft with respect to the cleaning roller, and wherein the urging member is configured to expand in the first direction along the guide to urge the bearing toward the photoconductor.

20. The process cartridge according to claim 19, wherein the urging member is a spring.

21. The process cartridge according to claim 19, further comprising:

a casing configured to receive the photoconductor, wherein the casing comprises a guide configured to guide the bearing toward the photoconductor, and wherein the urging member is a compression coil spring disposed in the guide, the compression coil spring being configured to urge the bearing toward the photoconductor.

* * * * *